US008118303B2

(12) United States Patent
Obuchi et al.

(10) Patent No.: US 8,118,303 B2
(45) Date of Patent: Feb. 21, 2012

(54) SHEET CONVEYING APPARATUS

(75) Inventors: Yusuke Obuchi, Abiko (JP); Kenichi Hayashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 151 days.

(21) Appl. No.: 11/470,815

(22) Filed: Sep. 7, 2006

(65) Prior Publication Data

US 2007/0075479 A1 Apr. 5, 2007

(30) Foreign Application Priority Data

Sep. 13, 2005 (JP) ..... 2005-264777

(51) Int. Cl.
*B65H 9/16* (2006.01)

(52) U.S. Cl. ..... 271/249; 271/250; 271/252; 271/253; 271/254

(58) Field of Classification Search ..... 271/176, 271/207, 273, 228, 248–250, 252–254, 242, 271/220, 227; 270/58.12, 58.16, 58.17, 58.27; 414/791.2; 399/395, 397, 404, 405, 407
See application file for complete search history.

(56) References Cited

U.S. PATENT DOCUMENTS

| | | | | |
|---|---|---|---|---|
| 3,788,142 | A | 1/1974 | Goransson | 73/230 |
| 4,635,920 | A | 1/1987 | Kodama | 271/81 |
| 5,037,081 | A * | 8/1991 | Engelhardt et al. | 271/207 |
| 5,219,159 | A * | 6/1993 | Malachowski et al. | 271/228 |
| 5,513,839 | A * | 5/1996 | Green | 270/58.07 |
| 6,019,365 | A * | 2/2000 | Matsumura | 271/227 |
| 6,059,285 | A * | 5/2000 | Suga et al. | 271/228 |
| 6,273,418 | B1 * | 8/2001 | Fujikura et al. | 271/228 |
| 6,283,655 | B1 * | 9/2001 | Thomas et al. | 400/634 |
| 6,371,472 | B1 * | 4/2002 | Miyake et al. | 270/58.14 |
| 6,581,930 | B2 * | 6/2003 | Kim | 271/272 |
| 6,783,124 | B2 * | 8/2004 | Tamura et al. | 270/58.07 |
| 6,799,013 | B2 * | 9/2004 | Shin | 399/405 |
| 7,011,306 | B2 * | 3/2006 | Kato et al. | 271/256 |
| 7,216,865 | B2 * | 5/2007 | Tamura et al. | 271/207 |

(Continued)

FOREIGN PATENT DOCUMENTS

| | | |
|---|---|---|
| JP | 61-33459 | 2/1986 |

(Continued)

OTHER PUBLICATIONS

Official Communication dated Mar. 29, 2011, issued by the European Patent Office, in counterpart European Application No. 06018650.9.

*Primary Examiner* — Kaitlin Joerger
*Assistant Examiner* — Prasad Gokhale
(74) *Attorney, Agent, or Firm* — Fitzpatrick, Cella, Harper & Scinto

(57) ABSTRACT

A sheet conveying apparatus has a first pair of rollers which nip and convey a sheet; a second pair of rollers provided on a downstream side of the first pair of rollers in a conveying direction of the sheet, which nip and convey a sheet; and a position detecting sensor which detects a position of a sheet in a width direction which is perpendicular to the conveying direction. When the first pair of rollers and the second pair of rollers nip and convey the sheet, the first pair of rollers and the second pair of rollers are simultaneously moved according to a position detected by the position detecting sensor in the same direction of the width direction which is perpendicular to the conveying direction.

16 Claims, 13 Drawing Sheets

U.S. PATENT DOCUMENTS

| | | | | |
|---|---|---|---|---|
| 7,243,917 | B2 * | 7/2007 | Knierim et al. | 271/228 |
| 7,252,287 | B2 * | 8/2007 | Tsutoh | 271/274 |
| 7,319,842 | B2 * | 1/2008 | Koyanagi et al. | 399/395 |
| 7,389,980 | B2 * | 6/2008 | Kushida | 270/58.12 |
| 7,401,776 | B2 * | 7/2008 | Obuchi et al. | 271/228 |
| 7,490,822 | B2 * | 2/2009 | Kushida | 270/58.12 |
| 7,575,230 | B2 * | 8/2009 | Kamiya et al. | 270/58.12 |
| 7,581,725 | B2 * | 9/2009 | Fujita et al. | 270/58.17 |
| 7,766,326 | B2 * | 8/2010 | Obuchi et al. | 271/228 |
| 2001/0006273 | A1 * | 7/2001 | Butterfass et al. | 271/227 |
| 2004/0046316 | A1 * | 3/2004 | Tsuzawa | 271/264 |
| 2004/0089232 | A1 | 5/2004 | Sasaki et al. | 118/620 |
| 2004/0145112 | A1 * | 7/2004 | Matsutomo et al. | 271/207 |
| 2004/0156032 | A1 * | 8/2004 | Murakami et al. | 355/407 |
| 2005/0035535 | A1 * | 2/2005 | Ogata et al. | 271/220 |
| 2006/0017209 | A1 | 1/2006 | Kushida et al. | 270/37 |
| 2006/0017218 | A1 | 1/2006 | Kawata et al. | 271/207 |
| 2006/0018694 | A1 | 1/2006 | Hayashi | 399/406 |
| 2006/0163801 | A1 * | 7/2006 | Dejong et al. | 271/227 |
| 2007/0045949 | A1 * | 3/2007 | Obuchi et al. | 271/293 |
| 2007/0108690 | A1 | 5/2007 | Hayashi et al. | 270/58.27 |
| 2007/0201920 | A1 * | 8/2007 | Obuchi et al. | 399/388 |
| 2008/0211177 | A1 * | 9/2008 | Obuchi et al. | 271/265.01 |
| 2009/0283957 | A1 * | 11/2009 | Fujita et al. | 271/10.12 |

FOREIGN PATENT DOCUMENTS

| | | |
|---|---|---|
| JP | 4-173659 | 6/1992 |
| JP | 4-260558 | 9/1992 |
| JP | 5-193788 | 8/1993 |
| JP | 8-12135 | 1/1996 |
| JP | 9-329885 | 12/1997 |
| JP | 2000-280554 | 10/2000 |
| JP | 2002-338089 | 11/2002 |
| JP | 2004-051256 | 2/2004 |
| JP | 2004-55401 | 2/2004 |

* cited by examiner

SHEET CONVEYING APPARATUS

BACKGROUND OF THE INVENTION

1. Field of the Invention

The present invention relates to a sheet conveying apparatus for conveying a sheet.

2. Description of the Related Art

In recent years, a sheet conveying apparatus in which sheets discharged from an image forming apparatus such as a printer or a copying machine are sorted into sheet groups, and the sorted sheets are each shifted in a width direction set for the corresponding sheet group, and are sorted and stacked on a stacking tray, is put to practical use.

An initial sheet processing apparatus having a sheet sorting function has adopted a mechanism in which the stacking tray is moved stepwise toward the width direction in order to shift stacking positions of the sheets toward the width direction. However, it is difficult to move a heavy stacking tray, on which as many as several thousand sheets are stacked, in the width direction from a mechanistic perspective and in view of power consumption. Accordingly, at present, a process tray is arranged on a front stage of the stacking tray, a sheet or a sheet bundle is moved toward the width direction on the process tray, and then the sheet or the sheet bundle is moved and stacked onto an ascendable/descendable stacking tray.

However, the process tray is large in size and constituted of a large number of parts in order to stack the sheets evenly, so the sheet processing apparatus inevitably becomes large in size. In addition, an arrangement place for the process tray is limited to a place immediately before the stacking tray, so it is necessary to arrange the process tray in each branch destination when a sheet conveying path is diverged into a plurality of conveying paths.

Accordingly, proposed is a mechanism in which a pair of rollers arranged on the sheet conveying path are moved toward the width direction while nipping the sheet to thereby shift a sheet conveying position in the width direction of the sheet.

JP S61-33459 A discloses a sheet processing apparatus built in an image forming apparatus. In the sheet processing apparatus, paired discharge rollers for discharging sheets onto a stacking tray are moved in an axial direction to sort and stack the sheets on the stacking tray. The sheets which are obtained after being subjected to image formation and image fixing, and are then discharged onto the stacking tray are moved in two steps toward the axial direction while being nipped by the paired discharge rollers, thereby being sorted and stacked on the stacking tray by shifting the stacking positions of the sheets in the width direction on the stacking tray.

In such the sorting and stacking mechanism disclosed in JP S61-33459 A, the sheets nipped by the paired discharge rollers hang down to the stacking tray, and the nipped sheets are moved in the width direction while causing a friction between the surfaces of a top sheet of the stacked sheets and the nipped sheets. As a result, there is a possibility that a stacked state of the sheets that have been stacked on the stacking tray is disordered.

Therefore, proposed is a technique in which a pair of conveying rollers arranged on an upstream side of the sheet conveying path are moved in the axial direction, and the sheets are moved in the width direction at a position not interfering with the sheets on the stacking tray during the sheet conveyance, thereby discharging the sheets to the paired discharge rollers.

However, it is difficult to secure a linear conveying path having the same length as that of the sheet at a front side of the paired discharge rollers. Accordingly, the sheet is moved in the width direction on a curved conveying path. In this case, there is a possibility that a difference between movement resistances in the width direction is generated between the upstream side of the sheet and the downstream side of the sheet, thereby making the sheet inclined.

The inclination of the sheet which is caused due to a sliding resistance generated between the sheet and a conveying guide is generally called a skew. The skew, generated when the pair of conveying rollers nipping the sheet are moved in the width direction, particularly prominently occurs, in a case of using a sheet having a strong stiffness such as a thick sheet, because the sliding resistance becomes large.

Further, proposed is a technique of achieving a position correcting function in the width direction, in which a position detecting sensor for detecting a position of a side edge of the sheet is combined with the pair of conveying rollers movable in the width direction, thereby aligning the side edges of the respective sheets, or stacking the sheets by aligning each one side edge of the sheets irrespective of using the sheets having different sizes. However, when the sheet itself is inclined through correction of the position of the side edge of the sheet, the side edges of the sheets stacked on the stacking tray are disordered, with the result that the correcting of the position of the side edge of the sheet becomes meaningless.

SUMMARY OF THE INVENTION

The present invention has an object to provide a sheet conveying apparatus and a sheet processing apparatus in which sheet is less likely to be inclined even when a thick sheet is used to be moved in a width direction in a conveying path having a small curvature radius.

According to one aspect of the present invention, a sheet conveying apparatus includes a first pair of rollers which nip and conveying a sheet; a second pair of rollers provided on a downstream side of the first pair of rollers in a conveying direction of the sheet, which nip and conveying a sheet; and a position detecting sensor which detects a position of a sheet in a width direction which is perpendicular to the conveying direction, in the sheet conveying apparatus, when the first pair of rollers and the second pair of rollers nip and convey the sheet, the first pair of rollers and the second pair of rollers are simultaneously moved according to a position detected by said position detecting sensor in the same direction of a width direction which is perpendicular to the conveying direction.

According to another aspect of the present invention, a sheet processing apparatus includes a sheet conveying path; a plurality of abutting members arranged to be spaced from each other in a sheet transfer direction in the sheet conveying path, and movable in the width direction perpendicular to the sheet transfer direction by each abutting against a surface of a sheet; a position detecting sensor which detects a position of a sheet in the width direction, and in the sheet processing apparatus, when the sheet is allowed to abut against the plurality of abutting members, the plurality of abutting members are simultaneously moved according to a position detected by said position detecting sensor in the same direction of the width direction, thereby moving the sheet in the width direction.

Further features of the present invention will become apparent from the following description of exemplary embodiments with reference to the attached drawings.

DESCRIPTION OF THE EMBODIMENTS

Hereinafter, a sheet processing apparatus 100, which is an embodiment of a sheet conveying apparatus according to the present invention, will be described with reference to the drawings. However, the sheet conveying apparatus according to the present invention is not limited to a subsidiary optional apparatus which is additionally provided to an apparatus main body 300 of an image forming apparatus. The sheet conveying apparatus may be obtained as an independent sheet processing apparatus including an independent microcomputer control device, or may be carried out by integrally and non-separably incorporating the sheet conveying apparatus into a housing of a copying machine, a facsimile machine, a monochrome printer, a multifunction machine having the functions thereof, or the like. Also, the sheet conveying apparatus may be applied to a sheet conveying apparatus for conveying a sheet in a multifunction machine main body or in a printer, or may be applied to an apparatus for conveying a sheet-like document.

Further, an image forming system of the image forming apparatus is not limited to an electrostatic photographic process described in this embodiment, but may be replaced with an ink-jet image forming apparatus, a stencil printing apparatus, other printing apparatus, and the like. In addition, it is also possible to constitute another embodiment according to the present invention by combining not only the image forming apparatus but also a document reading apparatus, a business machine, a sheet processing apparatus, and the like, or by integrally and non-separably incorporating the sheet conveying apparatus into such the apparatuses.

The sheet processing apparatus 100 according to this embodiment is not limited to a combination of limitative constitutional members described below, but other different embodiments may be constituted by a variety of combinations using various alternative members including those members.

<Image Forming Apparatus>

Figure 1:
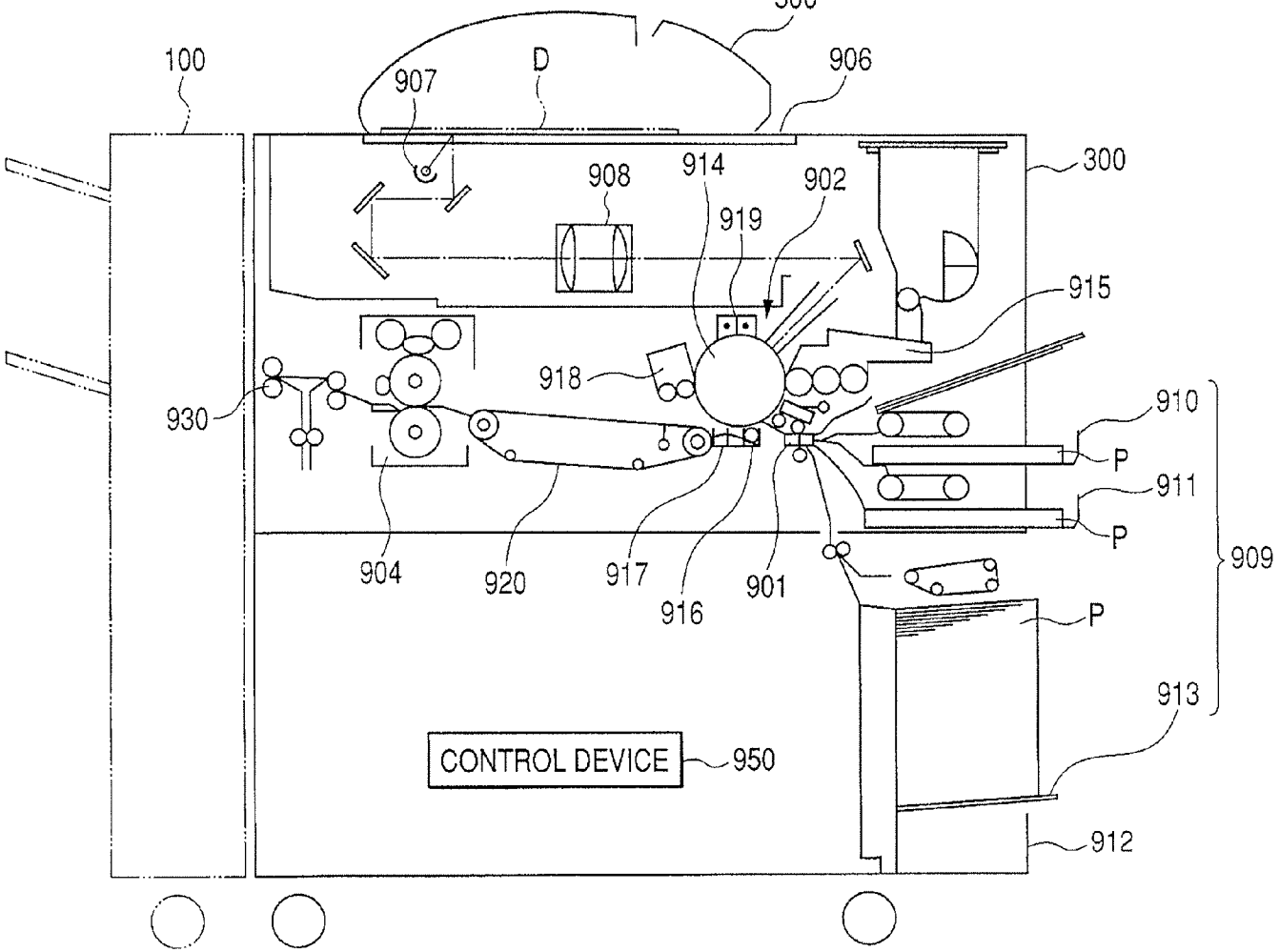
FIG. 1 is an explanatory view of an image forming apparatus mounted with a sheet processing apparatus according to this embodiment.

FIG. 1 is an explanatory view of an image forming apparatus mounted with a sheet processing apparatus according to this embodiment. The sheet processing apparatus 100 according to this embodiment is arranged on a downstream side of the apparatus main body 300 of the image forming apparatus as an optional apparatus controlled by a control device 950 of the apparatus main body 300.

As shown in FIG. 1, the apparatus main body (i.e., copying machine main body) 300 includes a platen glass plate 906 serving as a loading base for a document to be read, an automatic document feeder 500 which feeds the document to be read onto the platen glass plate 906, and the sheet processing apparatus 100 which stacks the sheets having images formed thereon and discharged from the apparatus main body 300. A sheet feed part 909 includes cassettes 910 and 911 which are detachably mounted to the apparatus main body 300 and contain sheets P subjected to image formation, and a deck 913 arranged in a pedestal 912.

When a sheet feed signal is outputted from the control device 950 provided to the apparatus main body 300, the sheets P are fed from the cassette 910 or 911, or the deck 913. Meanwhile, light emitted from a light source 907 and reflected by a document D loaded on the document loading base 906 is irradiated on a photosensitive drum 914 through a lens system 908. The photosensitive drum 914 is charged by a primary charger 919 in advance, and an electrostatic latent image is formed on the photosensitive drum 914 by being irradiated with light. The electrostatic latent image is developed by a developing device 915, thereby obtaining a toner image.

A skew of the sheet P fed from the sheet feed part 909 is corrected by a registration roller 901, and then the sheet P is conveyed to an image forming part 902 at a predetermined timing. In the image forming part 902, the toner image formed on a surface of the photosensitive drum 914 is transferred onto the conveyed sheet P by a transfer charger 916. The sheet P onto which the toner image is transferred is charged to a polarity opposite to that of the transfer charger 916 by a detach charger 917, and is detached from the photosensitive drum 914.

The detached sheet P is conveyed to a fixing device 904 by a conveying apparatus 920, and a transferred image is fixed onto the sheet P by the fixing device 904. The sheet P having an image fixed thereon is discharged from the apparatus main body through paired discharge rollers 930, and is fed in the sheet processing apparatus 100.

<Sheet Processing Apparatus>

Figure 2:
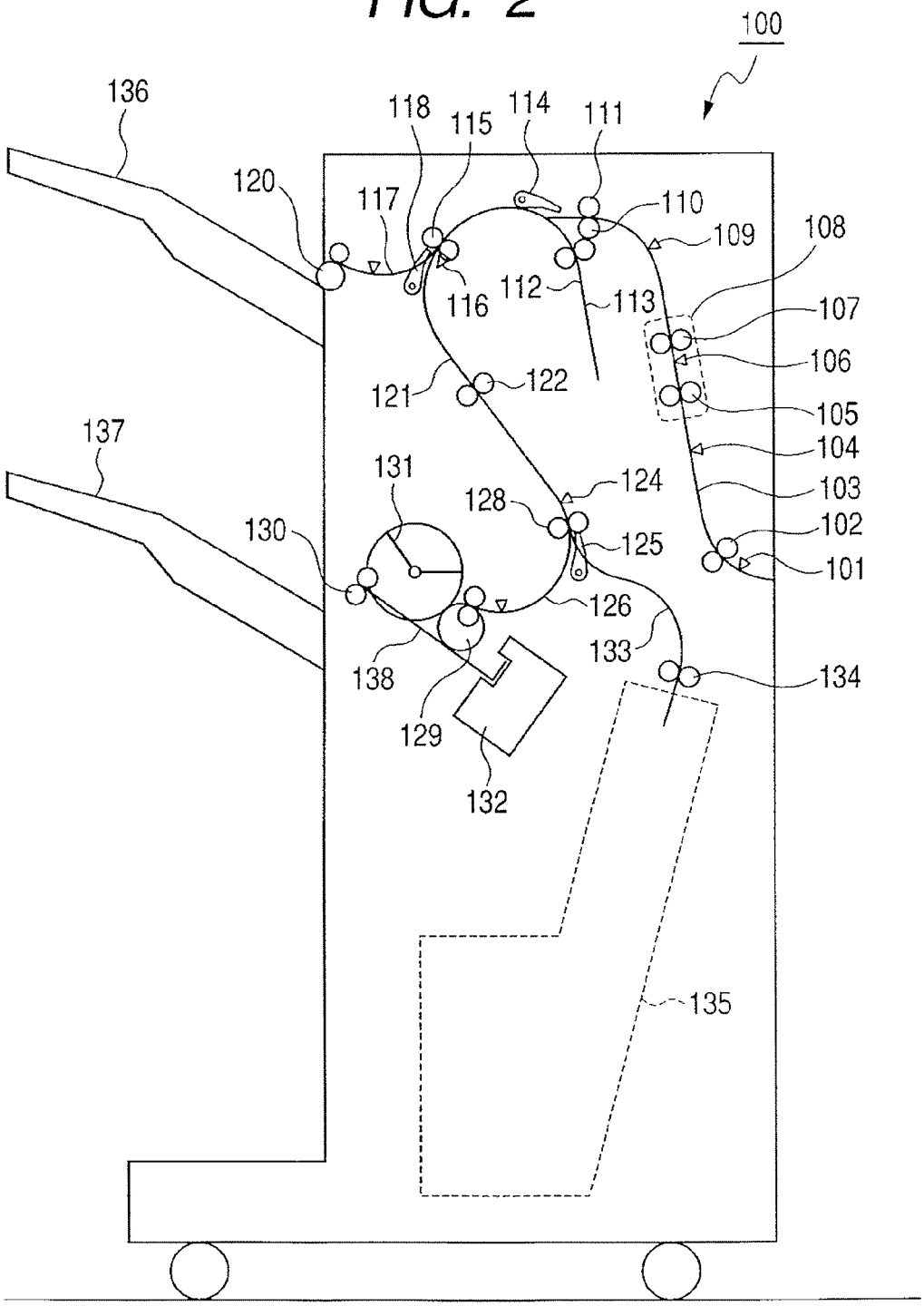
FIG. 2 is an explanatory view of a structure of the sheet processing apparatus according to this embodiment.

FIG. 2 is an explanatory view of a structure of the sheet processing apparatus according to this embodiment. The sheet processing apparatus 100 according to this embodiment is controlled by the control device 950 of the image forming apparatus to receive the sheet P from the apparatus main body 300. Then, the sheet processing apparatus 100 moves the shift unit 108 in the width direction while operating during the conveyance of the sheet, thereby performing a shift for sorting of the sheets P and correcting displacement in the side edges of the sheets P. Herein, the width direction is a direction perpendicular to a sheet conveying direction. The width direction is not limited to a direction in which an angle of inclination made by the sheet conveying direction is 90 degree.

The sheet P discharged from the image forming apparatus main body 300 is discharged to a pair of entrance rollers 102 of the sheet processing apparatus 100. At this time, a discharging timing of the sheet P is detected at the same time by an entrance sensor 101. The side edge position of the sheet P conveyed by the pair of entrance rollers 102 is detected by a side edge position detecting sensor 104 while the sheet P passes a conveying path 103. As a result, an amount of displacement generated in the width direction with respect to a central position of the sheet processing apparatus 100 is detected. The displacement amount in the width direction is herein defined as X (representing the center as 0 and forward direction of the apparatus as +; see FIGS. 5 to 7).

After the displacement of the sheet P in the width direction is detected, the sheet P is fed into the shift unit 108, and the displacement in the width direction is corrected and the shift for sorting is carried out. The shift unit 108 moves pairs of shift rollers 105 and 107 for conveying the sheet P, integrally with each other in the sheet width direction, while rotationally driving the pairs of shift rollers 105 and 107. The shift unit 108 and the operation thereof will be described later in detail with reference to FIGS. 3 and 4.

Conveying rollers 110 and release rollers 111 are conveying rollers capable of being brought into press-contact with and being set apart from each other. In a case where the sheet is large in size, the conveying rollers 110 and the release rollers 111 are set apart from each other prior to movement thereof in the width direction by the shift unit 108. This is because a resistance and a torque which are unnecessary for the sheet P moving in the width direction are not to be caused.

The sheet P conveyed by the conveying rollers 110 and the release rollers 111 which are brought into press-contact with each other is discharged to a pair of buffer rollers 115, and when the sheet P is discharged onto an upper tray 136, an upper path switching flapper 118 is allowed to face downward in advance by a solenoid or the like (not shown). As a result, the sheet P is guided into an upper path conveying path 117, and then discharged and stacked on the upper tray 136 by an upper discharge roller 120.

On the other hand, when the sheet P is not discharged onto the upper tray 136, the upper path switching flapper 118 is allowed to face upward in advance, so the sheet P is guided into a bundle conveying path 121, and is then discharged to a pair of bundle conveying rollers 124 from a pair of buffer rollers 115 through a bundle conveying path 122.

A saddle unit 135 arranged at a lower part of the sheet processing apparatus 100 performs a saddle process (i.e., bookbinding process) in which a sheet bundle is obtained, subjected to saddle stitch, and then subjected to half-fold process. The saddle process is a commonly used process, so the description thereof will be omitted herein. When the sheet P is subjected to the saddle process, a saddle path switching flapper 125 is allowed to face leftward in advance by the solenoid or the like (not shown), so the sheet P enters a saddle path 133, and is conveyed to the saddle unit 135 by a pair of saddle entrance rollers 134 to be subjected to the saddle process.

On the other hand, when the sheet P is discharged to a lower tray 137, the saddle switching flapper 125 is allowed to face rightward in advance. As a result, the sheet P enters a lower path 126 from the pair of bundle conveying rollers 124 to be discharged onto a process tray 138 by a pair of lower discharge rollers 128 and temporarily received on the process tray 138.

The sheets P discharged onto the process tray 138 are aligned on the process tray 138 after a predetermined number of sheets P are stacked by returning means such as a paddle 131 or a knurling belt 129, and are then subjected to a binding process by a stapler 132. A sheet bundle obtained on the process tray 138 is discharged and stacked on the lower tray 137 by a pair of bundle discharge rollers 130.

<Shift Unit>

Figure 3:
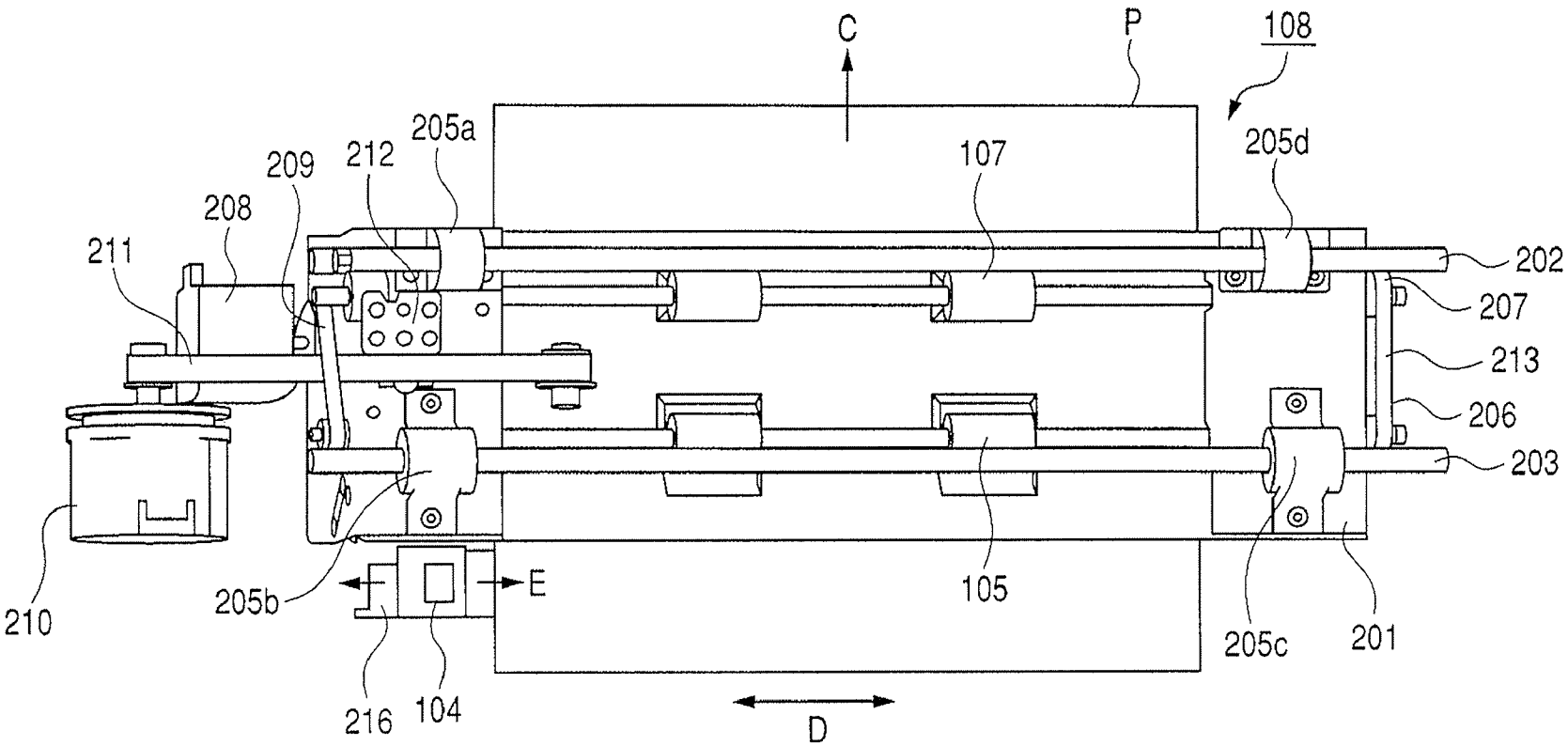
FIG. 3 is an explanatory view of a structure of a shift unit viewed from a side surface thereof.
Figure 4:
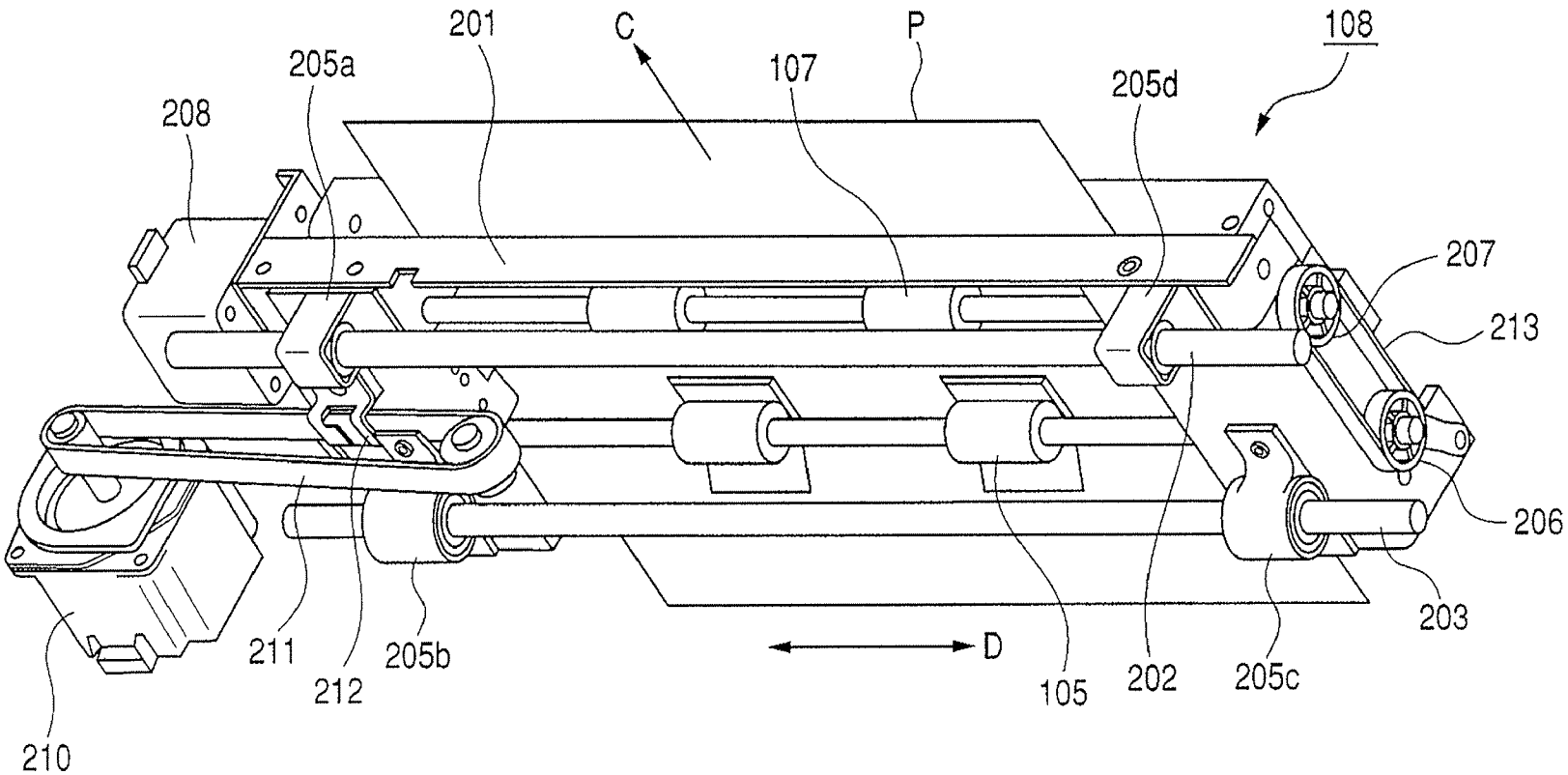
FIG. 4 is a perspective view of the shift unit.

FIG. 3 is an explanatory view of a structure of a shift unit viewed from a side surface thereof, and FIG. 4 is a perspective view of the shift unit. In the sheet processing apparatus 100 according to this embodiment, the pairs of shift rollers 105 and 107 are integrally moved in the width direction, thereby achieving the positioning in real time of the side edge of the sheet P without delaying the conveyance of the sheet P.

As shown in FIG. 3, the shift unit 108 moves in a direction indicated by the arrow D such that the entirety of a moving case 201, serving as a moving housing member which axially supports the pairs of shift rollers 105 and shift rollers 107, is guided in slide rails 202 and 203 serving as guide members. The slide rails 202 and 203 are fixed to a housing structure of the sheet processing apparatus 100 shown in FIG. 2. The moving case 201 is movably supported by four slide bushes 205*a*, 205*b*, 205*c*, and 205*d* along the slide rails 202 and 203.

The moving case 201 is mounted with a drive mechanisms for the pair of shift rollers 105 and pair of shift rollers 107. A rotational output of a shift conveying motor 208 serving as a drive source is transferred to a rotating shaft of the pair of shift rollers 105 by a drive belt 209. As shown in FIG. 4, the rotation of the pair of shift rollers 105 are transmitted from a pulley 206, which is fixed to the rotating shaft of the pair of shift rollers 105 on an opposite side of the shift conveying motor 208, to a pulley 207, which is fixed to the rotating shaft of the pair of shift rollers 107, through a drive belt 213. Accordingly, when the shift conveying motor 208 rotates, the pairs of shift rollers 105 and 107 are integrally rotated, thereby conveying the sheet P in a direction indicated by the arrow C.

A shift motor 210 which generates a driving force for moving the shift unit 108 along the slide rails 202 and 203 is fixed to the housing structure of the sheet processing apparatus 100 shown in FIG. 2. A rotational output of the shift motor 210 which adopts a step motor circulates a drive belt 211. The drive belt 211 is fixed to the moving case 201 by a fixing member 212, so the shift unit 108 moves in a direction indicated by the arrow D in accordance with a forward or reverse rotation of the shift motor 210.

As shown in FIG. 3, the side edge position detecting sensor 104 (see FIG. 2) arranged at an upstream of the shift unit 108 can move in directions indicated by the arrows E along a guide 216 by a drive mechanism (not shown). When a paper detecting sensor 106 shown in FIG. 1 which is arranged in the shift unit 108 detects the sheet P, the side edge position detecting sensor 104 starts moving from a home position at an outward side to an inward side to detect the position of the side edge of the sheet P, and then stops moving. The control device 950 shown in FIG. 1 detects the movement of the side edge position detecting sensor 104 to calculate the displacement amount in the width direction. Then, in a case of a non-shift mode, the displacement amount in the width direction is offset by moving the shift unit 108 in the width direction, thereby aligning the side edge positions of the sheets P. On the other hand, in a case of a shift mode, a shift process in which a shift amount preset with respect to the sheet P is added with the displacement amount in the width direction is performed.

Figure 13:
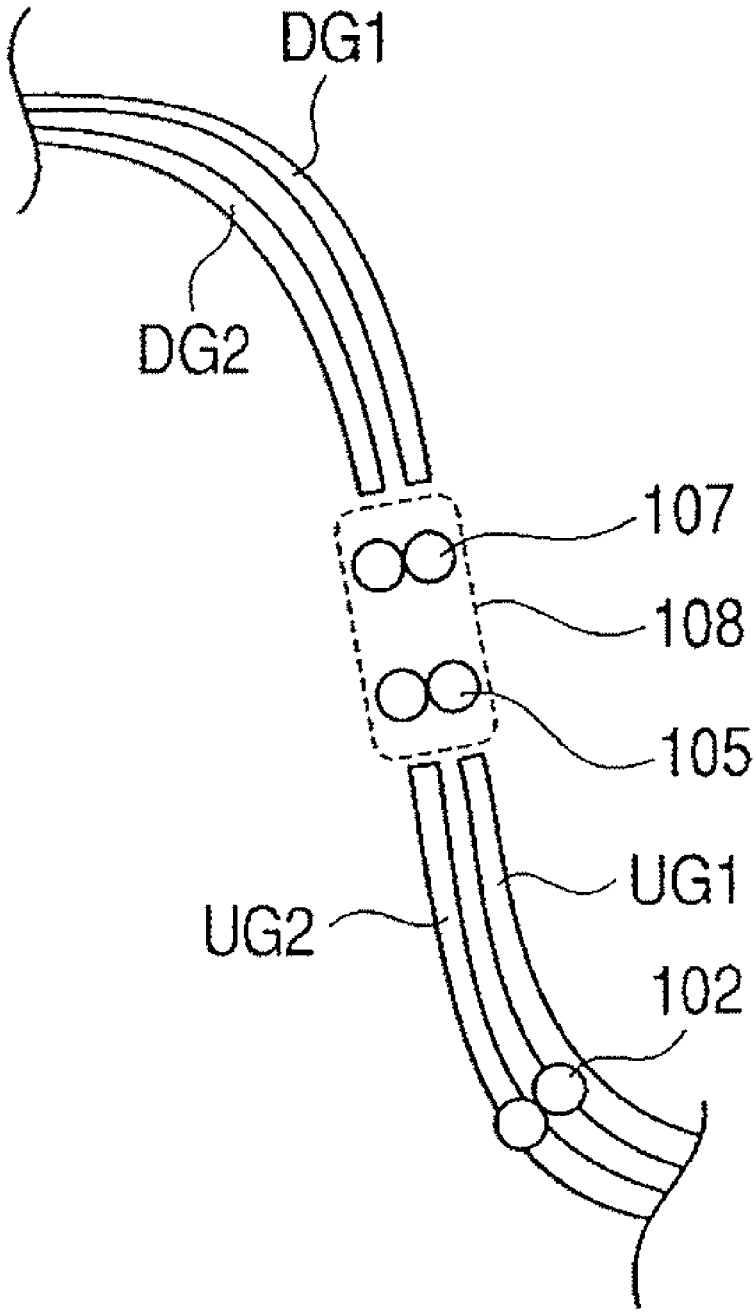
FIG. 13 is an explanatory view of a structure of a sheet processing apparatus according to this embodiment.

Here, as shown in FIG. 13, on the upstream side of the shift unit 108, there are provided a pair of upstream-side conveying guides UG1 and UG2 for guiding the sheet. The pair of upstream-side conveying guides UG1 and UG2 have a curved shape. On the downstream side of the shift unit 108, there are provided a pair of downstream-side conveying guides DG1 and DG2 for guiding the sheet. The pair of downstream-side conveying guides DG1 and DG2 have a curved shape.

The sheet P entering the shift unit 108 is nipped by the pairs of shift rollers 105 and 107 which is driven by the shift conveying motor 208, and is conveyed in the direction indicated by the arrow C. At this time, the side edge position detecting sensor 104 is moved in the direction indicated by the arrows E to detect a displacement amount X in the width direction of the sheet P. The control device 950 shown in FIG. 1 actuates the shift motor 210 by the shift amount obtained by adding the displacement amount X in the width direction with the shift amount necessary for each sheet P, while continuously conveying the sheet P, thereby moving the shift unit 108 in the direction indicated by the arrow D. The shift motor 201 is actuated to move the shift unit 108 in the width direction, with the result that the sheet P nipped and conveyed by the pairs of shift rollers 105 and 107 is moved in the width direction. The pair of upstream-side conveying guides UG1 and UG2 and the pair of downstream-side conveying guides DG1 and DG2 are fixed to the apparatus main body 300, so the sheet P moved in the width direction by the pairs of shift rollers 105 and 107 moves with respect to the pair of upstream-side conveying guides UG1 and UG2 and the pair of downstream-side conveying guides DG1 and DG2.

Here, the pairs of shift rollers 105 and 107 are two pairs of rollers, so it is possible to reliably grip the sheet P. For example, in a case of using a sheet having a long size such as an A-3 size sheet, even when a trailing edge side or a leading edge side of the sheet P is brought into contact with a curved portion of the pair of upstream-side conveying guides UG1 and UG2 or that of the pair of downstream-side conveying guides DG1 and DG2, the pairs of shift rollers 105 and 107 and the sheet P are less likely to slide on each other, and the position of the sheet P is less likely to be shifted from an assumed position. This is because the sheet P is nipped by the two pairs of rollers, and a nipping force of the two pairs of rollers easily overcomes a moment generated by a sliding resistance between the sheet and the guide when the sheet P is moved in the width direction. Therefore, a so-called skew or the like of a sheet, which is generated when a slide is caused on each surface of the pair of shift rollers during the shift, is not generated at all. As a result, it is possible to stably conveying the sheet P while being shifted.

According to this embodiment, the description as to the two pairs of shift rollers is given. However, the number of the pairs of shift rollers is not limited to two, but three or more pairs of shift rollers may be used to obtain the same effect.

<Shift Mode>

Figure 5:
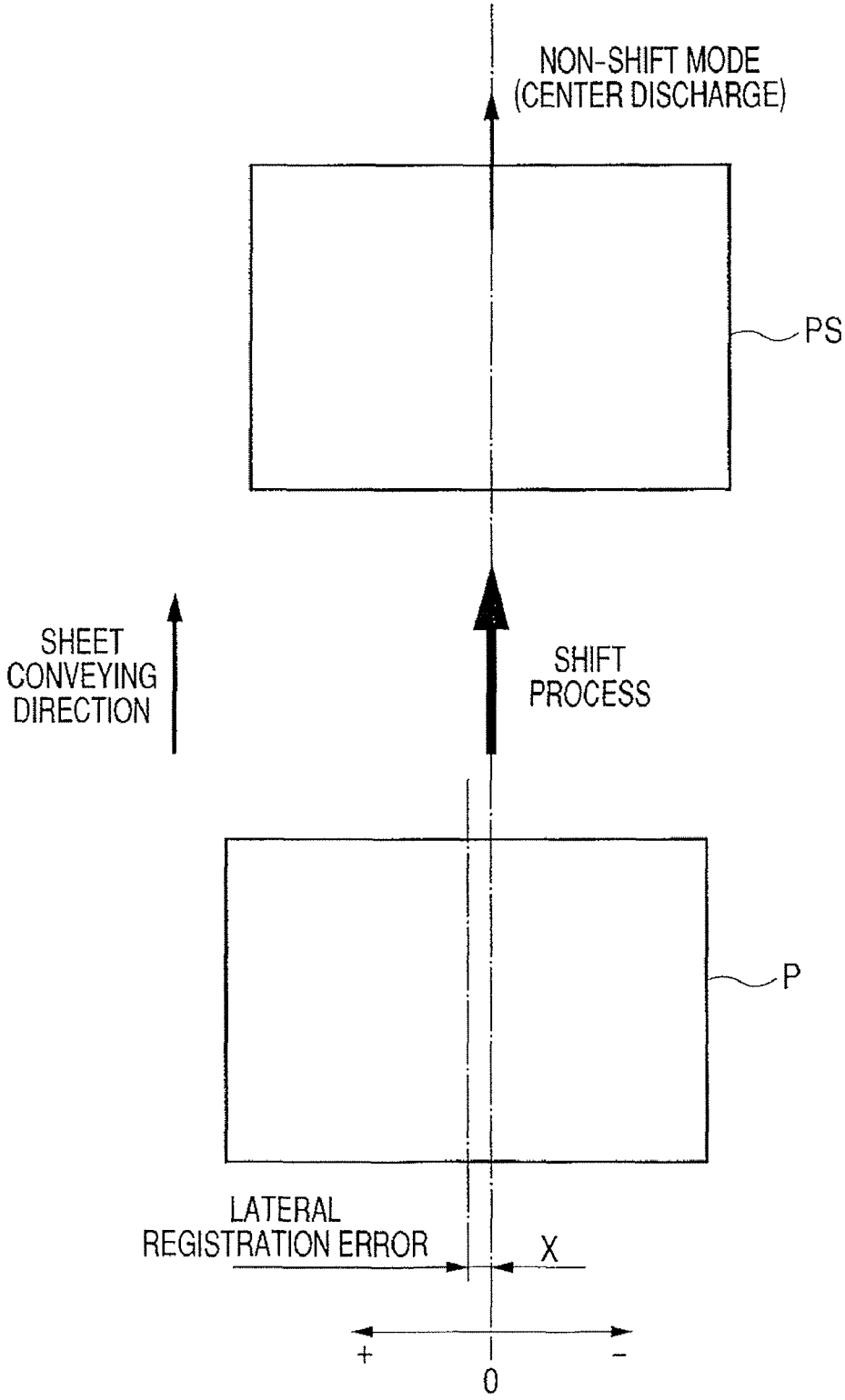
FIG. 5 is an explanatory view of an operation of the shift unit in a non-shift mode.
Figure 6:
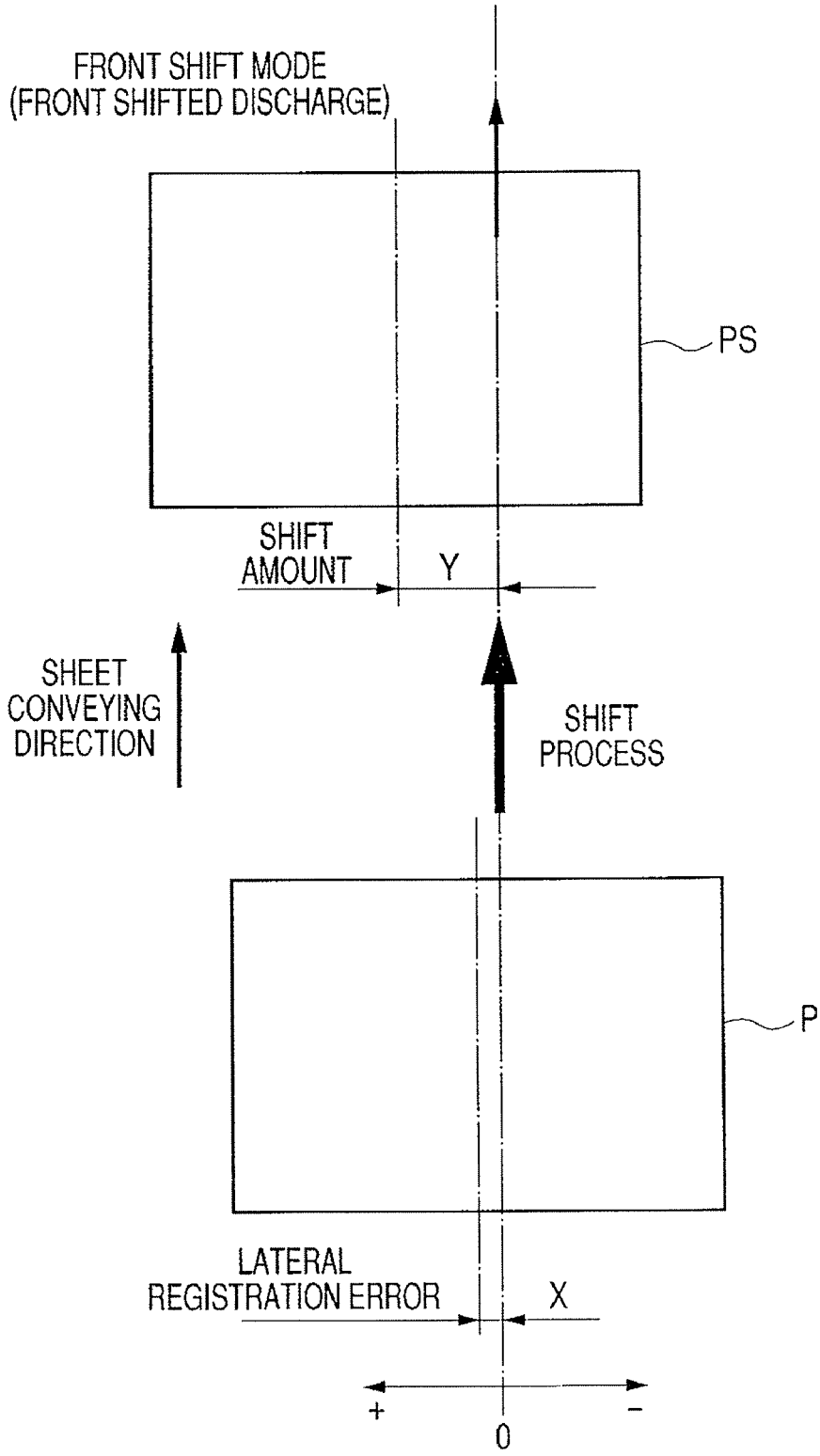
FIG. 6 is an explanatory view of an operation of the shift unit in a case of performing shift by an amount of +Y.
Figure 7:
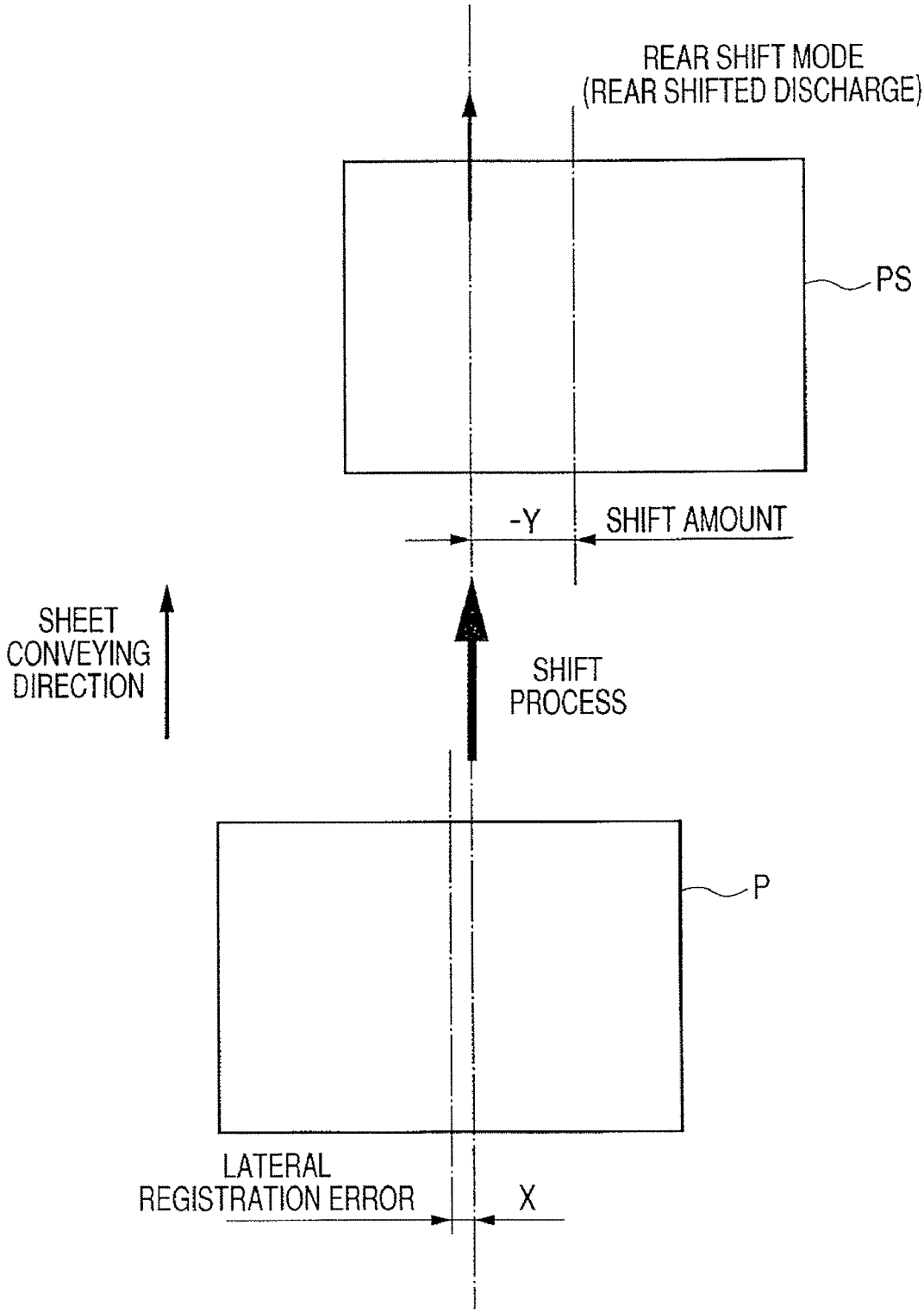
FIG. 7 is an explanatory view of an operation of the shift unit in a case of performing shift by an amount of −Y.
Figure 8:
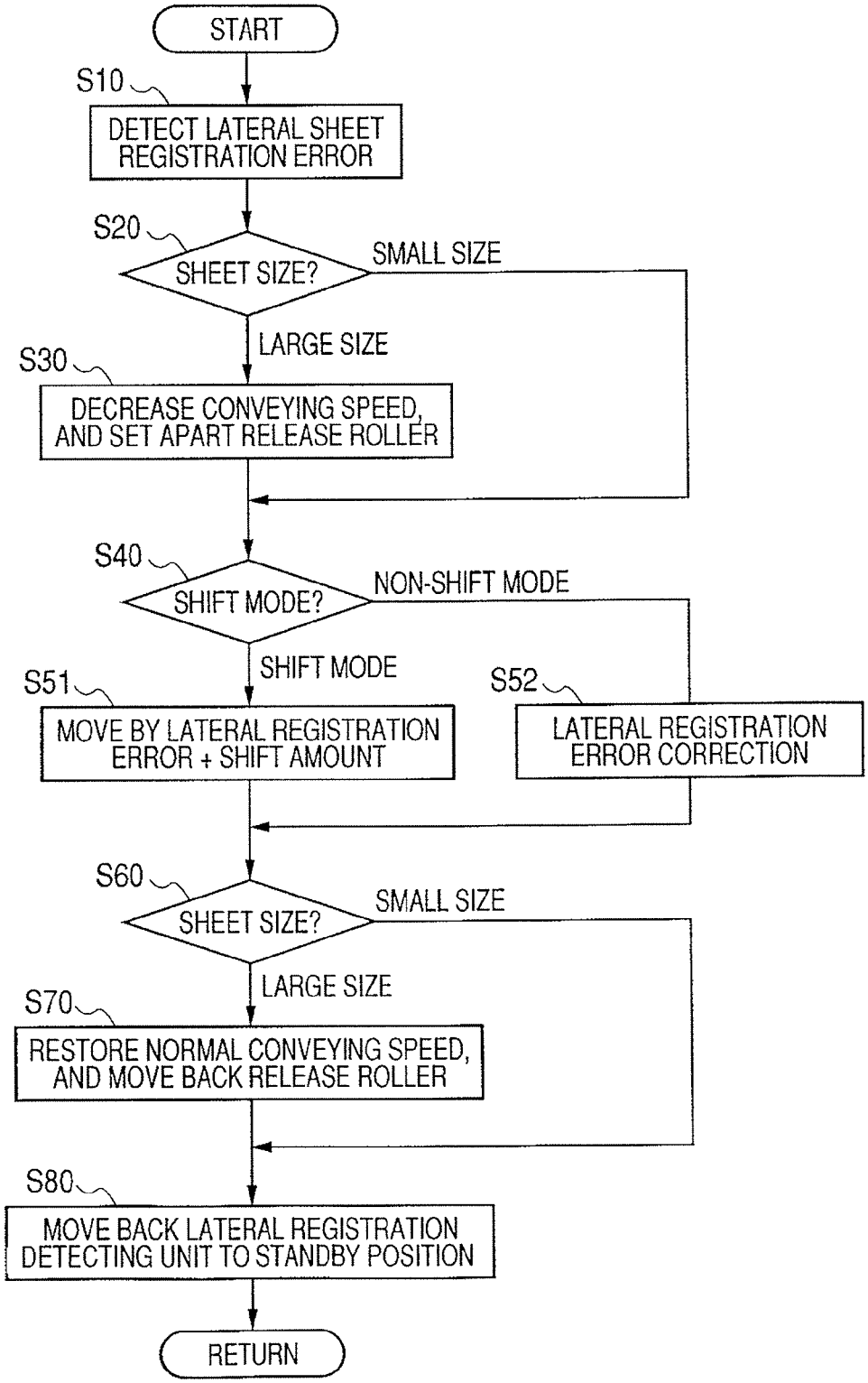
FIG. 8 is a flowchart of a shift mode operation.

FIG. 5 is an explanatory view of an operation of the shift unit in a non-shift mode. FIG. 6 is an explanatory view of an operation of the shift unit in a case of performing shift by an amount of +Y. FIG. 7 is an explanatory view of an operation of the shift unit in a case of performing shift by an amount of −Y. FIG. 8 is a flowchart of a shift mode operation. The sheet processing apparatus 100 according to this embodiment is capable of carrying out three shift modes, that is, a non-shift mode (see FIG. 5), a front shift mode (see FIG. 6), and a rear shift mode (see FIG. 7).

As shown in FIG. 5, the sheet P discharged from the image forming apparatus 300 shown in FIG. 1 is conveyed in a state where the sheet P is shifted by the amount X with respect to a central position of the sheet processing apparatus 100 (herein, called a displacement in the width direction). In the non-shift mode for center discharge, the side edge position detecting sensor 104 detects the displacement amount X in the width direction as shown in FIG. 3, and a movement Z1 of the shift unit 108 is derived from the following formula.

$$Z1=X\times(-1) \qquad \text{Formula (1)}$$

When the shift unit 108 is shifted by the movement Z1, the sheet P is moved toward the center of the sheet processing apparatus 100, thereby being conveyed in a state of a sheet PS shown in FIG. 5.

As shown in FIG. 6, the sheet P discharged from the image forming apparatus 300 shown in FIG. 1 is conveyed in a state where the sheet P is shifted by the amount X with respect to the central position of the sheet processing apparatus 100. In the front shift mode (i.e., front shifted discharge) of shifting the sheet P by an amount Y to a front side of the sheet processing apparatus 100 shown in FIG. 2, the side edge position detecting sensor 104 detects the displacement amount X in the width direction as shown in FIG. 3, and a movement Z2 of the shift unit 108 is derived from the following formula.

$$Z2=Y-X \qquad \text{Formula (2)}$$

When the shift unit 108 is shifted by the movement Z2, the sheet P is moved by the amount Y to the front side from the center of the sheet processing apparatus 100, thereby being conveyed in a state of a sheet PS shown in FIG. 6.

As shown in FIG. 7, the sheet P discharged from the image forming apparatus 300 shown in FIG. 1 is conveyed in a state where the sheet P is shifted by the amount X with respect to the central position of the sheet processing apparatus 100. In the rear shift mode (i.e., rear shifted discharge) of shifting the sheet P by the amount Y to a rear side of the sheet processing apparatus 100 shown in FIG. 2, the side edge position detecting sensor 104 detects the displacement amount X in the width direction as shown in FIG. 3, and a movement Z3 of the shift unit 108 is derived from the following formula.

$$Z3=Y+X \qquad \text{Formula (3)}$$

When the shift unit 108 is shifted by the movement Z3, the sheet P is moved to a position shifted by the amount Y to the rear side from the center of the sheet processing apparatus 100, thereby being conveyed in a state of a sheet PS shown in FIG. 7.

Referring to FIG. 2, as shown in FIG. 8, when the sheet P enters the shift unit 108, the control device 950 shown in FIG. 1 of the image forming apparatus moves the side edge position detecting sensor 104 to detect the displacement amount in the width direction of the sheet P (S10), and then determines a sheet size of the sheet P (S20).

Then, when determining that the sheet size of the sheet P is a large size (i.e., having a length of 216 mm or more in the conveying direction) (i.e., large size in S20), the control device 950 controls a drive mechanism (see FIG. 9; to be described later) to set the release rollers 111 apart from the conveying rollers 110, and controls the drive mechanism to decrease a transfer speed of the sheet P by the pairs of shift rollers 105 and 107 (S30). The reason for setting apart the release rollers 111 from the conveying rollers 110 is that the sheet P gets wrinkled when the shift unit 108 is moved in the width direction in a state where the sheet P is nipped in each nip between the release rollers 111 and the conveying rollers 110. Further, the reason for decreasing the transfer speed is that the leading edge of the sheet P needs to be prevented from reaching the nip between the pair of buffer rollers 115 without fault.

When determining that the sheet size of the sheet P is a small size (i.e., having a length of 216 mm or less in the conveying direction) (i.e., small size in S20), the shift process is completed before the leading edge of the sheet P reaches the nip between the conveying rollers 110 and the release rollers 111. Accordingly, a press-contact state and the transfer speed of the release rollers 111 and the conveying rollers 110 are not changed.

Next, the control device 950 determines whether or not the sheet processing apparatus 100 carries out the shift mode (S40). When determining that the sheet processing apparatus 100 carries out the shift mode (shift mode in S40), the control device 950 performs a control (S51) to carry out the shift process for an offset amount of the displacement amount in the width direction and a necessary shift amount as described with reference to FIGS. 6 and 7. When determining that the sheet processing apparatus 100 carries out the non-shift mode (non-shift mode in S40), the control device 950 performs a control to carry out the shift process for the offset amount of the displacement amount in the width direction (S52) as described with reference to FIG. 5.

Next, in order to perform after-treatment of Step S30, the control device 950 determines the sheet size of the sheet P (S60). When determining that the sheet size of the sheet P is the large size (i.e., large size in S60), the control device 950 performs a control to move back the release rollers 111 to be brought into press-contact with the conveying rollers 110, and to restore the decreased transfer speed to the normal transfer speed (S70).

Next, the control device 950 waits until the trailing edge of the sheet P passes through the shift unit 108, moves back the side edge position detecting sensor 104 to an original standby position, and further moves back the shift unit 108 to the original central position (S80), thereby completing a series of the operation. After that, the control device 950 waits until the subsequent sheet P is conveyed thereto, and returns to the initial sequence to repeat the same operation the required number of times.

In the sheet processing apparatus 100 according to this embodiment, the release rollers 111 are set apart from the conveying rollers 110 prior to the shift process performed by the shift unit 108, so it is possible to set a length of the conveying path which is not nipped by the pair rollers other than the pairs of shift rollers 105 and 107 to be short in order to shift the sheet P. The conveyed sheet P is subjected to the shift process within a long and free conveying path by the shift unit 108 according the set mode such as the shift mode and the non-shift mode.

<Description as to Operations of the Release Rollers>

Figure 9:
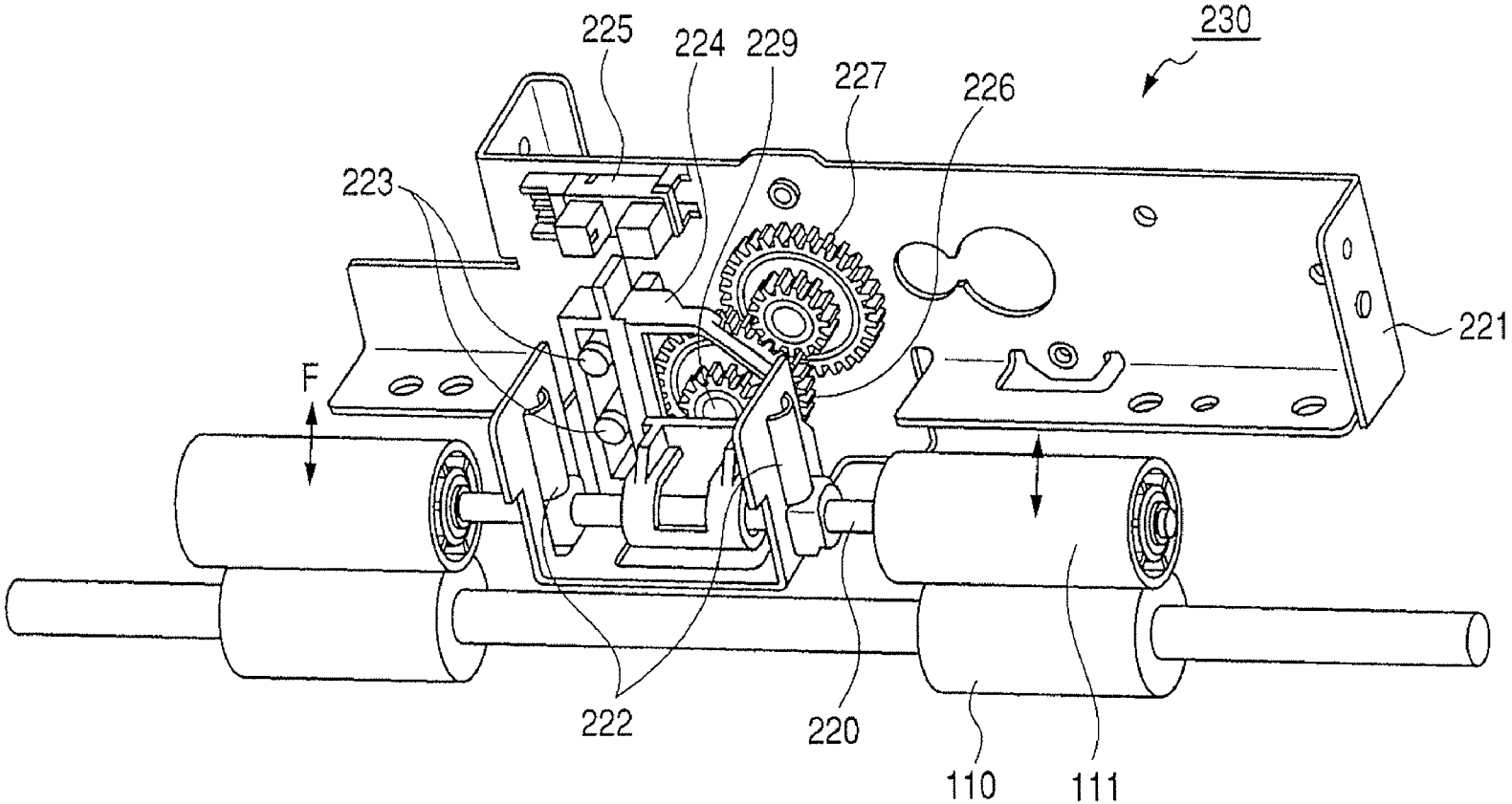
FIG. 9 is an explanatory view of a drive mechanism of release rollers.

FIG. 9 is an explanatory view of a drive mechanism of release rollers. In a drive mechanism 230 for the release rollers 111, a release frame 224 which axially supports the release rollers 111 is caused to ascend/descend with respect to a frame 221 fixed to the sheet processing apparatus 100 shown in FIG. 2, thereby bringing the release rollers 111 into press-contact with and being set apart from the conveying rollers 110.

As shown in FIG. 9, a rotating shaft 220 of the release rollers 110 is rotatably supported with respect to the release frame 224. The release frame 224 is guided by shafts 223 fixed to the frame 221, is free to ascend and descend in the direction indicated by the arrow F, and is urged upward by compressive forces of compression springs 222.

An output gear of a step motor (not shown) for driving and bringing the release rollers 111 into contact with the conveying rollers 110 is engaged with a drive gear 227. A rotation of the drive gear 227 is transmitted to a rack gear (not shown) fixed to the release frame 224 through a pinion gear 229 axially fixed to an intermediate gear 226. As a result, the pinion gear 229 allows the release frame 224 to ascend/descend in accordance with a forward or reverse rotation of the step motor (not shown). When the drive gear 227 is driven counterclockwise, the drive frame 224 is moved in a release direction (i.e., direction indicated by the arrow F). Each release position of the release rollers 111 is a height position where a home position sensor 225, which is fixed to the frame 221, detects a flag of the release frame 224. The press-contact state of the release rollers 111 is appropriately controlled by controlling a descending amount of the release frame 224 from the height position detected by the home position sensor 225.

<Buffer Mechanism>

Figure 10:
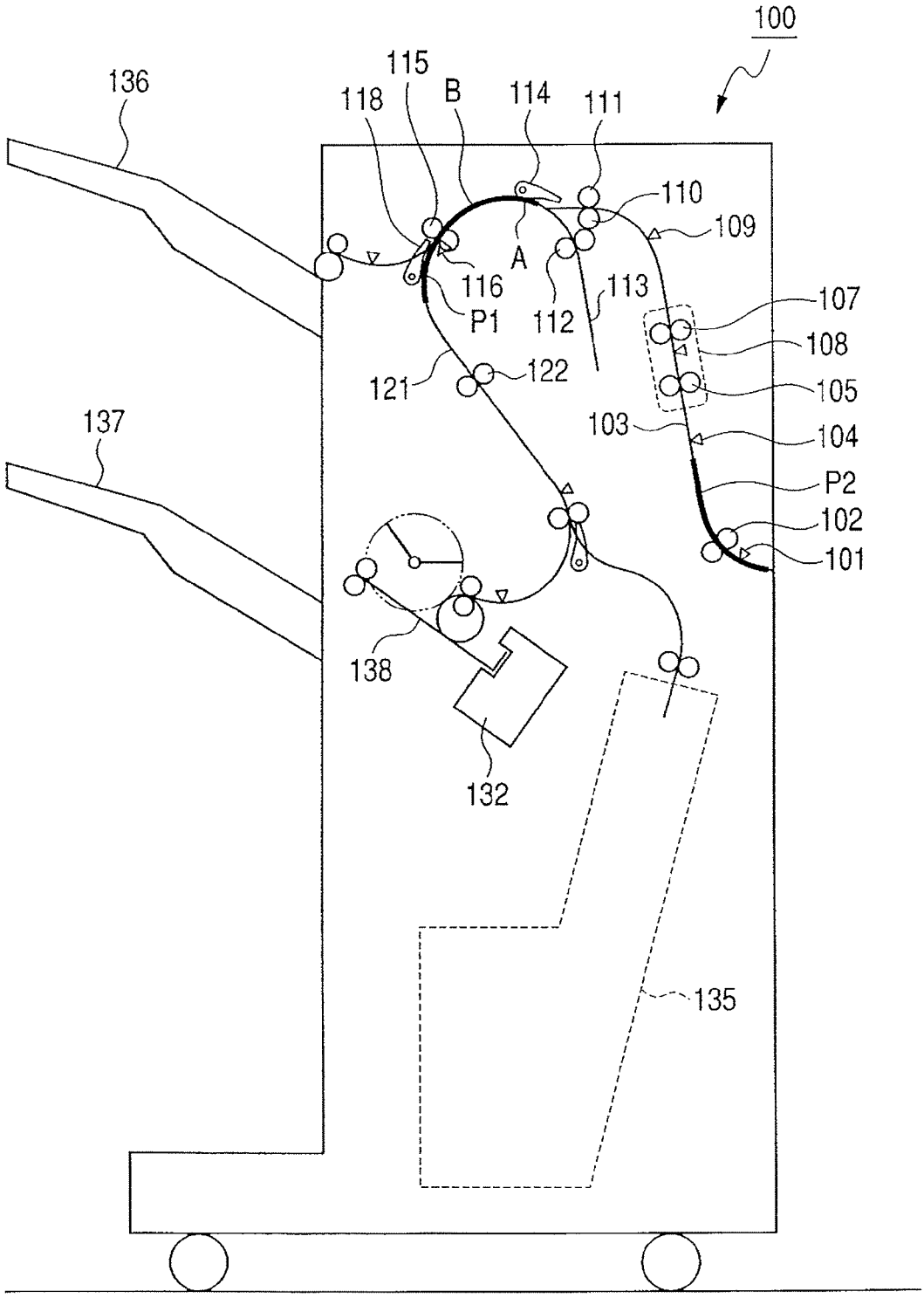
FIG. 10 is an explanatory view of a start position of a buffer process for a sheet.
Figure 11:
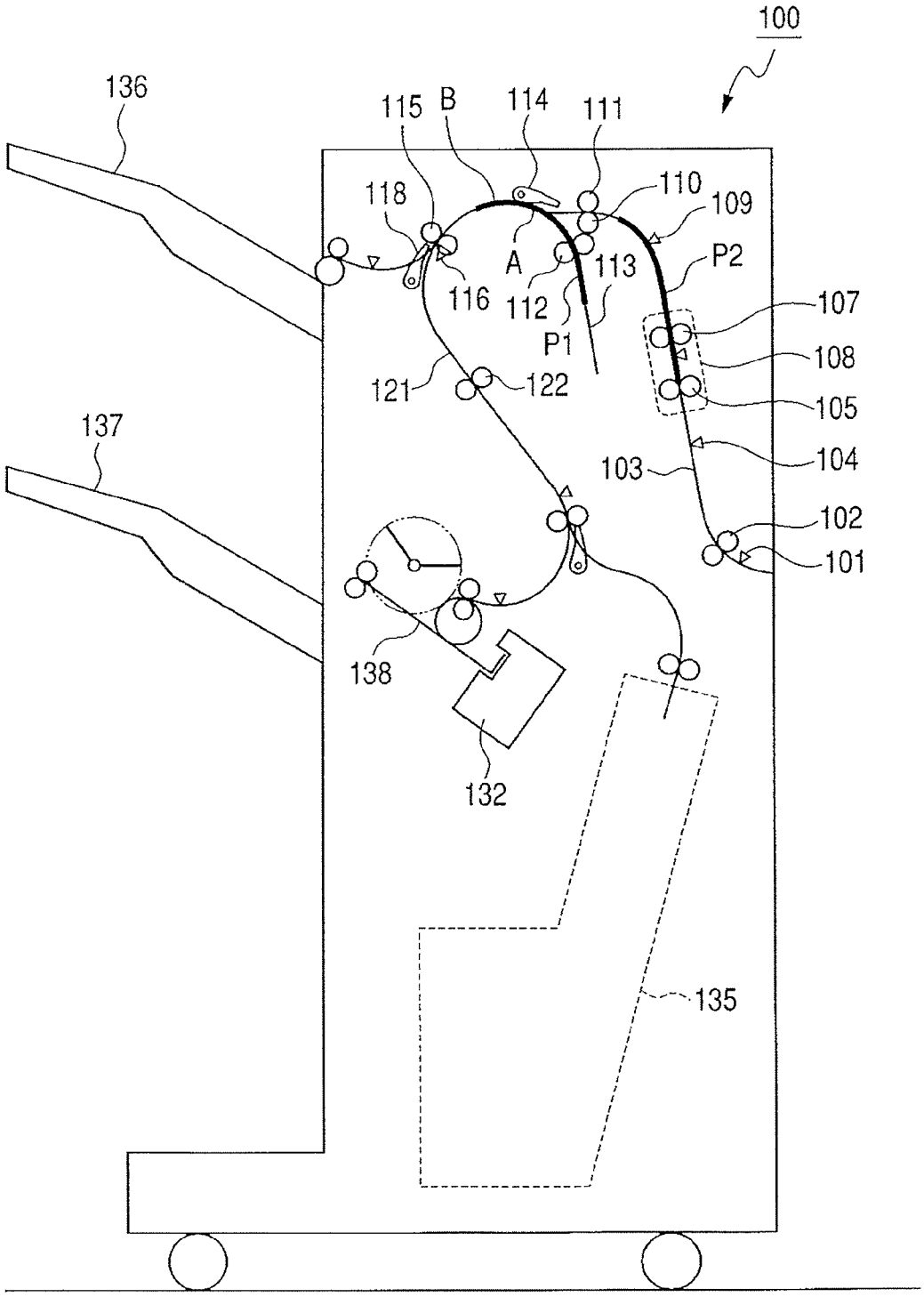
FIG. 11 is an explanatory view of a buffer position of the sheet.
Figure 12:
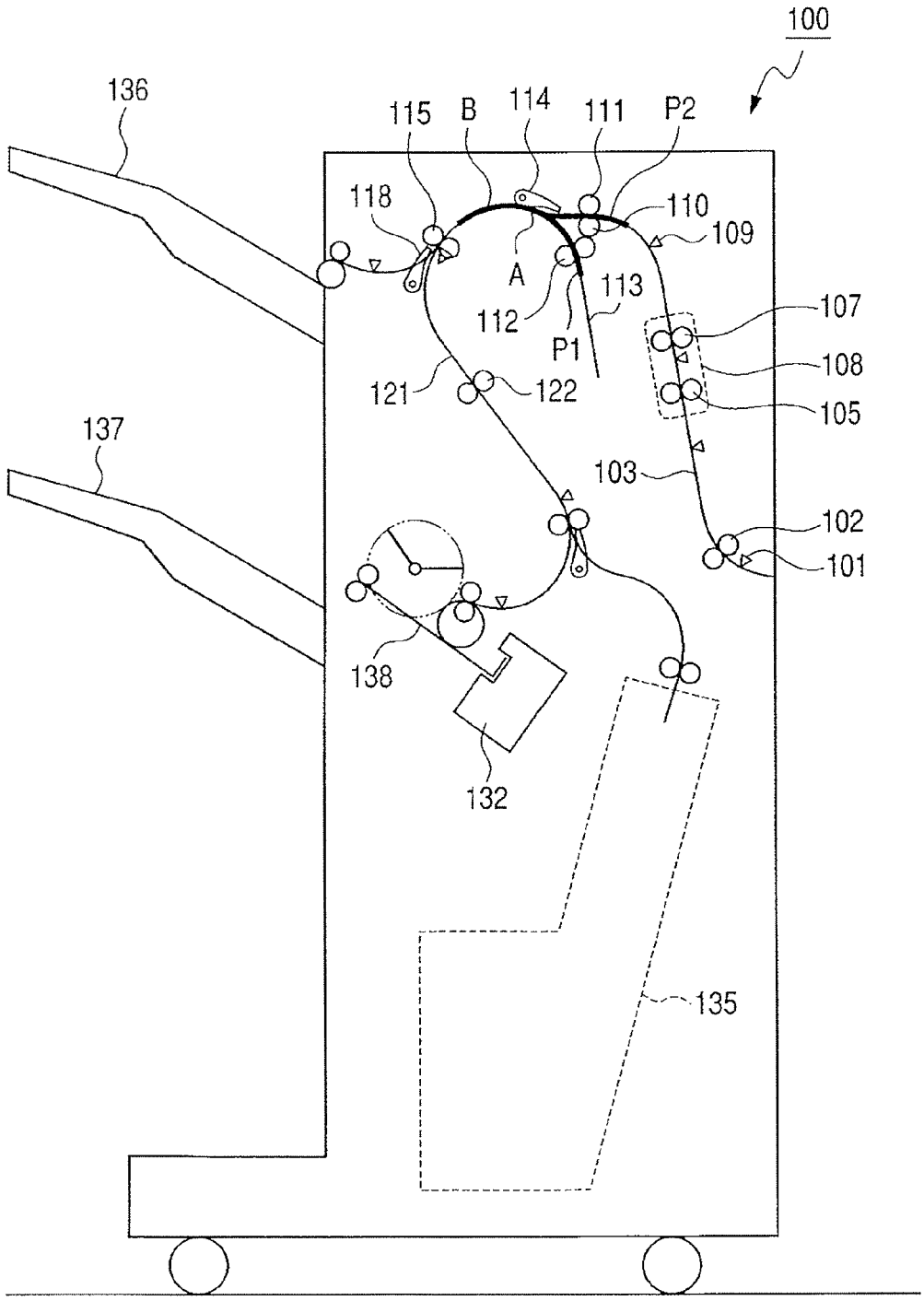
FIG. 12 is an explanatory view of a position for aligning leading edges of sheets.

FIG. 10 is an explanatory view of a start position of a buffer process for a sheet. FIG. 11 is an explanatory view of a buffer position of the sheet. FIG. 12 is an explanatory view of a position for aligning leading edges of sheets. FIGS. 10 to 12 are explanatory views of the buffer process of the sheet P in the sheet processing apparatus 100 shown in FIG. 2. The same reference numerals are given to constituents commonly used in FIG. 2, and the descriptions thereof will be omitted.

As shown in FIG. 10, in performing a staple process using the stapler 132 and a saddle process using the saddle unit 135, it is generally known that a certain period of time is required. Although depending on an image forming speed of the apparatus main body 300 shown in FIG. 1 of the image forming apparatus, such the period of time becomes longer than a time interval between a normal conveyance of sheets, for example, a period of time corresponding to that for forming an image on two or three sheets. In view of this, the sheet processing apparatus 100 according to this embodiment has a function in which the sheets P are allowed to stand by in a conveying path provided to an upstream of the stapler 132 or the saddle unit 135 while a plurality of sheets P are stacked, that is, a so-called buffer process function of the sheet P. As a result, it is possible to perform sheet processing using the stapler 132 or the saddle unit 135 without stopping the image formation performed by the apparatus main body 300.

A first sheet P1, which is conveyed to the nips between the conveying rollers 110 and the release rollers 111 after being subjected to the shift process performed by the shift unit 108, is guided into a sheet bundle conveying path 121 by the pair of buffer rollers 115. The control device 950 shown in FIG. 1 of the image forming apparatus sets, based on size information of the sheet P1 which is recognized in advance, a transfer distance which is to be traveled by the sheet P1 after a time point where a leading edge position thereof is detected by the buffer sensor 116 until the sheet P1 is stopped. Then, the control device 950 controls a drive mechanism (not shown) to stop the pair of buffer rollers 115, thereby stopping the conveyance of the sheet P1 at a timing when the trailing edge position of the sheet P1 reaches the position A as shown in FIG. 10.

After that, the control device 950 shown in FIG. 1 actuates a solenoid or the like (not shown) to cause the pair of buffer rollers 115 to rotate in a reverse direction in a state where a buffer path switching flapper 114 is allowed to rotate downward so as to guide the sheet P1 into a buffer path 113. As a result, the trailing edge of the sheet P1 enters the buffer path 113, and thereafter, the sheet P is reversely conveyed until the leading edge position of the sheet P1 reaches the position B as shown in FIG. 11. Then, the buffer path switching flapper 114 is rotated upward, thereby enabling a second sheet P2 to be received.

Next, when the buffer sensor 109 detects a leading edge position of the conveyed second sheet P2, the control device 950 shown in FIG. 1 starts driving the pair of buffer rollers so that the leading edges of the sheet P1 and the sheet P2 come to the same position in a state where the first sheet P1 being buffered reaches a predetermined transfer speed. Thus, positions of the leading edges of the sheet P1 and the sheet P2 are aligned as shown in FIG. 12.

In this case, when another subsequent sheet P3 (not shown) is further subjected to a overlap process, the control device 950 shown in FIG. 1 drives the pair of buffer rollers 115 to rotate in the reverse direction until positions of the trailing edges of the sheet P1 and the sheet P2 reach the position A. After that, the overlap process is repeatedly performed at the above-described timing, thereby making it possible to perform the overlap process with respect to the subsequent sheet P3 (not shown).

After a predetermined number of sheets are subjected to the overlap process by using the buffer path 113, a sheet bundle is sequentially discharged to the pair of buffer rollers 115 and the pair of buffer rollers 122 from the pair of buffer rollers 112, and is conveyed to the process tray 138 or the saddle unit 135 by a pair of sheet bundle conveying rollers 123.

It should be noted that the buffer mechanism of a switch-back reverse system is described herein, but buffer means is not limited to such the mechanism. It is also possible to use a buffer mechanism adopting a rotary system or other systems to obtain the same effect.

Further, the buffer mechanism is described above, but such the buffer mechanism is not essential for the sheet processing apparatus according to the present invention. In some cases, there rises no problem in using a sheet processing apparatus which is not provided with the buffer mechanism.

In the sheet processing apparatus 100 according to this embodiment, the shift unit 108 is arranged to the upstream of a post-processing unit such as the buffer path 113, the upper tray 136, the lower tray 137, and the saddle unit 135, thereby making it possible to share the same effect obtained through the shift unit 108. In addition, it is possible to discharge the sheet by setting a position shifted by the predetermined shift amount or a central position of the sheet processing apparatus 100 when the sheet is discharged to the respective units.

In particular, the sheet P is shifted upstream of the upper tray 136, it is also possible to perform a sort mode discharge (i.e., sorting and stacking) even on the upper tray 136 which is not provided with the process tray 138.

In the above-mentioned embodiment, illustrated is the embodiment in which the control device 950 of the image forming apparatus controls and drives the shift conveying motor 208 and the shift motor 210 of the sheet processing apparatus, and controls the conveying rollers 110 to be brought into press-contact with and set apart from the release rollers 111. However, such the control device may be provided to the sheet processing apparatus.

The sheet processing apparatus 100 according to this embodiment includes the pairs of shift rollers 105 and 107, which are arranged in the conveying path of the sheet P with a distance therebetween in the conveying direction of the sheet P and are each abut against a surface of the sheet P so as to be movable in the width direction of the sheet P, and the control device 950 for simultaneously moving the pairs of shift rollers 105 and 107 in the sheet width direction at a timing when the pairs of shift rollers 105 and 107 are each abut against the sheet P. As a result, at a position where the pairs of shift rollers 105 and 107 are apart from each other in the conveying direction of the sheet P, the sheet P is moved in the width direction at the same time, so the sheet P is less likely to be inclined as compared with a case where only the pair of shift rollers 105 are moved. In other words, a moment generated in the periphery of the pair of shift rollers 105 due to a difference between the movement resistances in the width direction of the sheet P or the like on the upstream side and the downstream side of the sheet P, is sustained by a friction of the sheet P in the other pair of shift rollers 107, thereby making it possible to resist the rotation of the sheet P in a conveyance surface thereof.

Accordingly, it is possible to stably move the sheet P horizontally, even in a case of using a sheet P having a strong stiffness such as a thick sheet, or even on the curved conveying path. Even in a case of correcting the displacement in the width direction of the sheet P which is caused in the image forming apparatus or an independent sheet processing apparatus 100, or performing a process of aligning side surfaces of the sheet P, it is possible to align side surfaces of the sheets P stacked on the upper tray 136 in a highly attractive manner without further inclining the sheet P.

In the sheet processing apparatus 100 according to this embodiment, the pairs of shift rollers 105 and 107 are roller members which are arranged in the conveying path of the sheet P and convey the sheet P, and the control device 950 moves the pairs of shift rollers 105 and 107 in the width direction of the sheet P during the conveyance of the sheet P by the pairs of shift rollers 105 and 107. Thus, it is possible to rapidly accomplish the movement in the width direction of the sheet P in real time without delaying the conveyance of the sheet P, and there is no need to decrease a process speed of the image forming apparatus provided on the upstream side of the sheet processing apparatus 100, or to stand by the sheet P on the upstream side.

The sheet processing apparatus 100 according to this embodiment includes the upper tray 136, the lower tray 137, the process tray 138, the saddle unit 135, and the buffer path 113 which are provided for performing the processing with respect to the sheet P. The pairs of shift rollers 105 and 107 are arranged on the upstream side of the conveyance branch point of the sheet P with respect to those processing parts. As a result, the processing parts can share processing effects such as the movement in the width direction by using the pairs of the shift rollers 105 and 107, positioning of the side edges of the sheets P, and alignment in the width of the sheets P, so it is unnecessary to arrange a mechanism for obtaining such the processing result in each of the processing parts. Further, when there is provided the mechanism for obtaining such the processing result, a load of the similar processing on those processing parts is reduced.

The sheet processing apparatus 100 according to this embodiment includes the side edge position detecting sensor 104 which detects the position of the sheet in the width direction. The control device 950 determines the movement X in the width direction according to the output of side edge position detecting sensor 104. Therefore, even when the positions of the side edges of the sheets P received from the apparatus main body 300 vary, it is possible to stack the sheets P in a highly attractive manner in which each one side surface of the sheets P is aligned.

The sheet processing apparatus 100 according to this embodiment includes the release rollers 111 and the conveying rollers 110 which are provided on the downstream side of the pairs of shift rollers 105 and 107, and are brought into press-contact with and being set apart from each other to convey the sheet P. The control device 950 set apart the release rollers 111 from the conveying rollers 110 before moving the pairs of shift rollers 105 and 107 in the width direction. Thus, the shift unit 108 is moved in the width direction in a state where the sheet P is nipped at each nip between the release rollers 111 and the conveying rollers 110, thereby making it possible to prevent the sheet P from being wrinkled.

The sheet processing apparatus 100 according to this embodiment includes the upper tray 136 on which the sheets P are stacked, and the upper discharge roller 120 which is arranged on the downstream side with respect to the pairs of shift rollers 105 and 107 and discharges the sheets P onto the upper tray 136. The control device 950 determines the movement +Y in the width direction which is differently set for each group of the sheets P. Accordingly, it is possible to stack the sheets P in a highly distinguished and attractive manner in which the sheets P are orderly sorted into each sheet group with each sheet group being arranged backward or forward, and with each one side surface of the sheets being aligned in each sheet group.

The sheet processing apparatus 100 according to this embodiment includes the upper tray 136 and the lower tray 137 on each of which the sheets P are received. The shift unit 108 is arranged on the upstream side of the conveying path branch point of the sheet P with respect to the upper tray 136 and the lower tray 137. Thus, it is possible to load the sheets P, in which the displacement in the width direction is offset or the sorting is performed for each sheet group in the shift unit 108, on both of the upper tray 136 and the lower tray 137. In other words, even in the case where the process tray 138 is not provided, it is possible to sort the sheets rapidly and in real time by using the shift unit 108, and in addition, there is no need to additionally provide the process tray 138 to the upper tray 136 for sorting the sheets.

The sheet processing apparatus 100 according to this embodiment includes the buffer path 113 which allows the sheet P conveyed in the conveying path to temporarily stand by, and the shift unit 108 arranged at the upstream side of the buffer path 113. Thus, the side edges of a plurality of sheets that are allowed to stand by in the buffer path 113 are plainly aligned, so there is no displacement in the side edges of the overlapped sheets which is difficult to be eliminated in the saddle unit 135 or the process tray 138. As a result, the side edges of the sheet bundle subjected to the bookbinding process or that subjected to the staple process are aligned in a highly attractive manner.

The sheet processing apparatus 100 according to this embodiment includes, in the sheet processing apparatus 100 including a conveying branch point of the sheet P, the pairs of shift rollers 105 and 107 that are arranged with a distance therebetween in the conveying direction of the sheet P on the upstream side of the conveying branch point of the sheet P, the moving case 201 which supports the pairs of shift rollers 105 and 107 and is movable in the width direction of the sheet P integrally with the pairs of the shift rollers 105 and 107, the shift motor 210 which drives and moves the moving case 201 in the width direction of the sheet P, the drive belt 211, and the fixing member 212. As a result, a plurality of processing members provided at the downstream side of the conveying branch point of the sheet can share processing effects such as the movement in the width direction by using the pairs of the shift rollers 105 and 107, positioning of the side edge of the sheet P, and alignment in the width of the sheet P. Also, by the movement of the moving case 201, it is possible to realize a precise control with a simple structure and with the minimum number of parts since the pairs of the shift rollers 105 and 107 can be moved simultaneously in the width direction at the same speed and by the same amount of movement. Further, by incorporating the shift unit 108 having the small number of parts and a reduced size and weight, a degree of freedom in design for the conveying path of the sheet processing apparatus 100 is increased, thereby making it possible to realize a short conveying path which causes less trouble by providing the small number of conveying rollers.

The shift unit 108 mounted on the sheet processing apparatus 100 according to this embodiment includes, in the shift unit 108 which moves the sheet P toward the direction perpendicular to the conveying direction of the sheet P along the sheet surface, the pairs of shift rollers 105 and 107 which are arranged with a distance therebetween in the conveying direction, and are integrally movable in the direction perpendicular to the conveying direction of the sheet P in contact with the sheet P. In other words, the rotating structure as in the pairs of shift rollers 105 and 107 and the structure in which both of the rollers nipping the sheet move the sheet in the width direction are not essential. The structure may be replaced with a combination of members one of which does not rotate and has a fixed surface (e.g., a roller member and a low frictional plate which are brought into press-contact with each other), a combination of two members both of which do not rotate and one of which has a fixed surface (e.g., a friction pad and a low frictional plate which are brought into press-contact with each other), or the like. By arranging two or more of one or two structures selected among those combinations at a distance in the conveying direction, it is also possible to realize another embodiment of the shift unit according to the present invention with less rotation of the sheet in accordance with the movement in the width direction of the sheet.

The shift unit 108 mounted on the sheet processing apparatus 100 according to this embodiment includes the moving case 201 which integrally supports the pairs of shift rollers 105 and 107, and the slide rails 202 and 203 which guide the moving case 201 in the width direction and movably supports the moving case 201 in the width direction. Accordingly, it is possible to simultaneously move the pairs of shift rollers 105 and 107 by one motor and with one intermediate transfer structure at the same speed and by the same distance without increasing the number of parts. In addition, by incorporating the shift unit 108 which is reduced in size and weight without increasing the number of parts, it is possible to increase a degree of freedom in design for the conveying path of the sheet processing apparatus 100, and to realize a short conveying path which causes less trouble by providing the small number of conveying rollers.

The shift unit 108 mounted on the sheet processing apparatus 100 according to this embodiment includes the pairs of shift rollers 105 and 107 which are each rotatably supported by the moving case 201. Mounted on the moving case 201 are the conveying motor 208 which conveys the sheet P by rotationally driving the pairs of shift rollers 105 an 107, the drive belts 209 and 213, and pulleys 206 and 207. Accordingly, by moving the shift unit 108 in the width direction while continuously conveying the sheet P, it is possible to position the side edge of the sheet P rapidly and in real time without delaying the conveyance of the sheet P. Also, it is possible to convey the sheet P only by supplying power to the shift unit 108, and to make the entirety of the necessary drive mechanism compact on the moving case 201.

Further, according to this embodiment, a plurality of nip members simultaneously move the sheet in the width direction at positions apart from the conveying direction of the sheet, so the sheet is less likely to incline as compared with the case of moving with only one of the nip members. In other words, a moment, which is generated in the periphery of one of the nip members due to a difference in moment between the movement resistances of the sheet at the upstream side and the downstream side of the sheet, is sustained by the friction of the sheet in the other one of the nip members, thereby making it possible to resist the rotation of the sheet within a conveying surface of the sheet.

Therefore, even in a case of using a sheet having a strong stiffness such as a thick sheet, or even on the curved conveying path, it is possible to stably move the sheet horizontally. In addition, even in a case of correcting the displacement in the width direction of the sheet which is caused in the image forming apparatus or an independent sheet processing apparatus, or performing a process of aligning side surfaces of the sheets, it is possible to align each of the one side surfaces of the sheets stacked on the stacking tray in a highly attractive manner without further inclining the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-264777, filed Sep. 13, 2005, which is hereby incorporated by reference herein in its entirety.

What is claimed is:

1. A sheet conveying apparatus, comprising:

a shift unit which conveys a sheet, and which is capable of moving in a width direction perpendicular to a sheet conveying direction while the shift unit conveys the sheet;

a drive mechanism which moves the shift unit in the width direction;

a detecting portion which is moveable in the width direction and which detects a side edge position of the sheet to be conveyed to the shift unit; and a control device which controls the drive mechanism to move the shift unit in the width direction, wherein the control device obtains a displacement in the width direction of the sheet to be conveyed to the shift unit based on a detecting result of the detecting portion, and controls the drive mechanism so as to move the shift unit in the width direction by a moving amount calculated from a predetermined shift amount in the width direction with respect to a central position of the sheet processing apparatus for sorting each sheet group and a correcting amount for correcting the displacement in the width direction.

2. A sheet conveying apparatus according to claim 1, further comprising a plurality of processing units which perform processing with respect to the sheet conveyed by the shift unit, wherein the shift unit is arranged upstream of a sheet conveying branch point for the plurality of processing units.

3. A sheet conveying apparatus according to claim 1, further comprising a pair of conveying rotary members capable of being brought into press-contact with and being set apart from each other, which is provided at least one of upstream of the shift unit and downstream of the shift unit, wherein the pair of conveying rotary members is set apart from each other before the shift unit is moved in the width direction.

4. A sheet conveying apparatus according to claim 1, further comprising:

a stacking tray on which the sheet conveyed by the shift unit is stacked; and a discharge portion arranged downstream of the shift unit, which discharges the sheet conveyed by the shift unit onto the stacking tray, wherein the shift unit is moved in the width direction so that the discharged sheets are stacked in each sheet group at positions different in the width direction on the stacking tray.

5. A sheet conveying apparatus according to claim 1, wherein the shift unit includes:

a first pair of rollers which nips and conveys a sheet;

a second pair of rollers which is provided downstream of the first pair of rollers in the conveying direction, and which nips and conveys the sheet.

6. A sheet conveying apparatus according to claim 5, further comprising:

a pair of upstream conveying guides provided upstream of the shift unit in the sheet conveying direction, which guide the sheet; and a pair of downstream conveying guides provided downstream of the shift unit in the sheet conveying direction, which guides the sheet, wherein one of the pair of upstream conveying guides and the pair of downstream conveying guides has a curved shape; and the shift unit is moved in the width direction with respect to the pair of upstream conveying guides and the pair of downstream conveying guides, thereby moving the sheet.

7. A sheet conveying apparatus according to claim 1, wherein the control device determines a different moving amount in the width direction of the shift unit for each sheet group.

8. A sheet conveying apparatus according to claim 1, wherein the control device controls the drive mechanism so as to move the shift unit in a different direction in the width direction for each sheet group.

9. An image forming apparatus, comprising:

an image forming part which forms an image on a sheet;

a sheet conveying apparatus; and a control device which controls the sheet conveying apparatus, the sheet conveying apparatus comprising:

a shift unit which conveys a sheet, and which is capable of moving in a width direction perpendicular to a sheet conveying direction while the shift unit conveys the sheet;

a drive mechanism which moves the shift unit in the width direction; and a detecting portion which is moveable in the width direction and which detects a side edge position of the sheet to be conveyed to the shift unit, wherein the control device obtains a displacement in the width direction of the sheet to be conveyed to the shift unit based on a detecting result of the detecting portion, and controls the drive mechanism so as to move the shift unit in the width direction by a moving amount calculated from a predetermined shift amount in the width direction with respect to a central position of the sheet processing apparatus for sorting each sheet group and a correcting amount for correcting the displacement in the width direction.

10. An image forming apparatus according to claim 9, wherein the sheet conveying apparatus includes a plurality of processing units which perform processing with respect to the sheet conveyed by the shift unit, and wherein the shift unit is arranged upstream of a sheet conveying branch point for the plurality of processing units.

11. An image forming apparatus according to claim 9, wherein the sheet conveying apparatus includes a pair of conveying rotary members capable of being brought into press-contact with and being set apart from each other, which is provided at least one of upstream of the shift unit and downstream of the shift unit, and wherein the pair of conveying rotary members is set apart from each other before the shift unit is moved in the width direction.

12. An image forming apparatus according to claim 9, wherein the sheet conveying apparatus includes a stacking tray on which the sheet conveyed by the shift unit is stacked and a discharge portion arranged downstream of the shift unit, which discharges the sheet conveyed by the shift unit onto the stacking tray, and wherein the shift unit is moved in the width direction so that the discharged sheets are stacked in each sheet group at positions different in the width direction on the stacking tray.

13. An image forming apparatus according to claim 9, wherein the shift unit includes:

a first pair of rollers which nips and conveys a sheet; and a second pair of rollers which is provided downstream of the first pair of rollers in the conveying direction, and which nips and conveys the sheet.

14. An image forming apparatus according to claim 13, wherein the sheet conveying apparatus includes:

a pair of upstream conveying guides which is provided upstream of the shift unit in the sheet conveying direction, and which guides the sheet; and a pair of downstream conveying guides which is provided downstream of the shift unit in the sheet conveying direction, and which guides the sheet, wherein one of the pair of upstream conveying guides and the pair of downstream conveying guides has a curved shape, and the shift unit is moved in the width direction with respect to the pair of upstream conveying guides and the pair of downstream conveying guides, thereby moving the sheet.

15. An image forming apparatus according to claim 9, wherein the control device determines a different moving amount in the width direction of the shift unit for each sheet group.

16. An image forming apparatus according to claim 9, wherein the control device controls the drive mechanism so as to move the shift unit in a different direction in the width direction for each sheet group.

* * * * *